US009982331B2

(12) United States Patent
Miura et al.

(10) Patent No.: US 9,982,331 B2
(45) Date of Patent: May 29, 2018

(54) ABRASION RESISTANT STEEL PLATE HAVING EXCELLENT LOW-TEMPERATURE TOUGHNESS AND EXCELLENT CORROSIVE WEAR RESISTANCE

(71) Applicant: JFE STEEL CORPORATION, Tokyo (JP)

(72) Inventors: Shinichi Miura, Tokyo (JP); Keiji Ueda, Tokyo (JP); Nobuyuki Ishikawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 369 days.

(21) Appl. No.: 14/429,499

(22) PCT Filed: Sep. 13, 2013

(86) PCT No.: PCT/JP2013/005434
§ 371 (c)(1),
(2) Date: Mar. 19, 2015

(87) PCT Pub. No.: WO2014/045553
PCT Pub. Date: Mar. 27, 2014

(65) Prior Publication Data

US 2015/0225822 A1 Aug. 13, 2015

(30) Foreign Application Priority Data

Sep. 19, 2012 (JP) ..... 2012-205305

(51) Int. Cl.

| | |
|---|---|
| ***C22C 38/12*** | (2006.01) |
| ***C22C 38/18*** | (2006.01) |
| ***C22C 38/22*** | (2006.01) |
| ***C22C 38/60*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/20*** | (2006.01) |
| ***C22C 38/26*** | (2006.01) |
| ***C22C 38/28*** | (2006.01) |
| ***C22C 38/32*** | (2006.01) |
| ***C21D 8/02*** | (2006.01) |
| ***C21D 1/18*** | (2006.01) |
| ***C21D 6/00*** | (2006.01) |
| ***C22C 38/24*** | (2006.01) |

(Continued)

(52) U.S. Cl.

CPC ..... *C22C 38/60* (2013.01); *C21D 1/18* (2013.01); *C21D 1/185* (2013.01); *C21D 6/002* (2013.01); *C21D 6/004* (2013.01); *C21D 6/005* (2013.01); *C21D 6/008* (2013.01); *C21D 8/0247* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/42* (2013.01); *C22C 38/44* (2013.01); *C22C 38/46* (2013.01); *C22C 38/48* (2013.01); *C22C 38/50* (2013.01); *C21D 9/46* (2013.01); *C21D 2211/008* (2013.01)

(58) Field of Classification Search

CPC ..... C22C 38/12; C22C 38/18; C22C 38/22
See application file for complete search history.

(56) References Cited

U.S. PATENT DOCUMENTS

| | | | | |
|---|---|---|---|---|
| 8,097,099 | B2 | 1/2012 | Saitoh et al. | |
| 2008/0156400 | A1* | 7/2008 | Nakashima | C21C 7/0006 148/331 |

(Continued)

FOREIGN PATENT DOCUMENTS

| | | | |
|---|---|---|---|
| CN | 101775545 | * | 7/2010 |
| EP | 1 930 459 | A1 | 6/2008 |

(Continued)

OTHER PUBLICATIONS

Jun. 10, 2014 Office Action issued in Japanese Patent Application No. 2014-510589.

(Continued)

*Primary Examiner* — Matthew E Hoban
(74) *Attorney, Agent, or Firm* — Oliff PLC

(57) ABSTRACT

An abrasion resistant steel plate which possesses excellent abrasion resistance, excellent low-temperature toughness and excellent corrosive wear resistance. The abrasion resistant steel plate has the composition comprising by mass %: 0.10% to 0.20% C, 0.05% to 1.00% Si, 0.1% to 2.0% Mn, 0.020% or less P, 0.005% or less S, 0.005% to 0.100% Al, one or two kinds of components selected from a group consisting of 0.05% to 2.0% Cr and 0.05% to 1.0% Mo, and remaining Fe and unavoidable impurities as a balance. Content of solute Cr in steel (Crsol) and the content of solute Mo in steel (Mosol) satisfy the formula 0.05≥(Crsol+2.5Mosol)≥2.0. Steel plate has a structure where an as-quenched martensitic phase forms a main phase and a grain size of prior austenite grains is 30 μm or less, and surface hardness of the steel plate is 360 or more at Brinel hardness HBW10/3000.

16 Claims, No Drawings

(51) Int. Cl.

| | |
|---|---|
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| *C21D 9/46* | (2006.01) |

(56) References Cited

U.S. PATENT DOCUMENTS

| | | | | |
|---|---|---|---|---|
| 2009/0010794 | A1 | 1/2009 | Turconi et al. | |
| 2010/0059150 | A1 | 3/2010 | Saitoh | |
| 2010/0139820 | A1 | 6/2010 | Kumagai et al. | |
| 2012/0199255 | A1* | 8/2012 | Anelli | C21D 1/18 148/593 |

FOREIGN PATENT DOCUMENTS

| | | | |
|---|---|---|---|
| EP | 2 133 442 | A1 | 12/2009 |
| EP | 2 180 076 | A1 | 4/2010 |
| EP | 2 290 116 | A1 | 3/2011 |
| EP | 2447386 | A1 | 5/2012 |
| EP | 2 589 675 | A1 | 5/2013 |
| EP | 2 589 676 | A1 | 5/2013 |
| EP | 2808411 | A1 | 12/2014 |
| JP | S61-166954 | A | 7/1986 |
| JP | 01-172550 | A | 7/1989 |
| JP | H02-179842 | A | 7/1990 |
| JP | 05-51691 | A | 3/1993 |
| JP | H08-041535 | A | 2/1996 |
| JP | H08-295990 | A | 11/1996 |
| JP | 09-118950 | A | 5/1997 |
| JP | 11-071631 | A | 3/1999 |
| JP | 2000-297344 | A | 10/2000 |
| JP | 2002-020837 | A | 1/2002 |
| JP | 2002-080930 | A | 3/2002 |
| JP | 2002-115024 | A | 4/2002 |
| JP | 2003-171730 | A | 6/2003 |
| JP | 2004-162120 | A | 6/2004 |
| JP | 2005-256169 | A | 9/2005 |
| JP | 2006-328512 | A | 12/2006 |
| JP | 2007-070713 | A | 3/2007 |
| JP | 2007-092155 | A | 4/2007 |
| JP | 2007-197813 | A | 8/2007 |
| JP | 2009-030092 | A | 2/2009 |
| JP | 2009-030093 | A | 2/2009 |
| JP | 2009-030094 | A | 2/2009 |
| JP | 2010-121191 | A | 6/2010 |
| JP | 2010-159466 | A | 7/2010 |
| JP | 2011-179122 | A | 9/2011 |
| JP | 2012-177190 | A | 9/2012 |
| WO | 2009/087990 | A1 | 7/2009 |
| WO | 2010/150915 | A1 | 12/2010 |

OTHER PUBLICATIONS

May 22, 2012 International Search Report issued in PCT/JP2012/059126.

Nov. 3, 2014 Search Report issued in European Application No. 12765557.9.

Nov. 3, 2014 Search Report issued in European Application No. 12764169.4.

May 22, 2012 International Search Report issued in PCT/JP2012/059127.

Oct. 11, 2011 International Search Report issued in PCT/JP20111065410.

Oct. 11, 2011 International Search Report issued in PCT/JP20111065416.

Mar. 24, 2015 International Preliminary Report on Patentability and Written Opinion issued in PCT/JP20131005434.

Sep. 24, 2015 Search Report issued in European Application No. 13838200.7.

Jan. 26, 2016 Office Action issued in Chinese Application No. 201380048590.9.

Nov. 9, 2016 Office Action issued in Korean Patent Application No. 10-2015-7005646.

Apr. 19, 2016 Office Action issued in Korean Application No. 10-2015-7005646.

Bramtitt, et al., "Metallographer's Guide—Practices and Procedures for Irons and Steels," ASM International (2002).

Jun. 29, 2017 Office Action issued in U.S. Appl. No. 14/429,557.

Dec. 17, 2013 International Search Report issued in PCT/JP2013/005434.

Dec. 6, 2017 Office Action issued in U.S. Appl. No. 14/429,557.

* cited by examiner

ABRASION RESISTANT STEEL PLATE HAVING EXCELLENT LOW-TEMPERATURE TOUGHNESS AND EXCELLENT CORROSIVE WEAR RESISTANCE

TECHNICAL FIELD

The present application relates to an abrasion resistant steel plate suitably used for parts of industrial machines, transporting machines and the like.

BACKGROUND ART

Conventionally, with respect to parts for industrial machines, transporting machines and the like such as, for example, a power shovel, a bulldozer, a hopper, a bucket or a dump truck used in a construction site, a civil engineering site, a mine or the like, wear is generated due to a contact of the part with earth, sand or the like. Accordingly, in manufacturing the above-mentioned parts, a steel material having excellent abrasion resistance is used for extending lifetime of the parts. In an actual in-use environment, various states such as a dry state or a wet state are considered as a state of earth, sand or the like. Particularly, there may be a case where earth, sand or the like in a wet state contain a corrosive material. Accordingly, the wear due to earth, sand or the like in a wet state becomes wear in an environment which contains the corrosive material, that is, so-called corrosive wear. This corrosive wear has been known as an extremely severe wear environment. In view of the above, there has been a demand for an abrasion resistant steel material having excellent corrosive wear resistance.

The use of these industrial machines, transporting machines and the like in a low-temperature range of 0° C. or below is also considered. Accordingly, a steel material which is used for parts of these industrial machines, transporting machines and the like is requested to possess the excellent low-temperature toughness in addition to the abrasion resistance and corrosive wear resistance.

To satisfy such a request, for example, patent literature 1 proposes a method of manufacturing a high-hardness abrasion resistant steel having excellent low-temperature toughness, wherein hot rolling is applied to a steel slab having the composition containing by mass %: 0.30% to 0.50% C, proper amounts of Si, Mn, Al, N, Ti, Nb and B respectively, and 0.10% to 0.50% Cr and 0.05% to 1.00% Mo, thereafter, quenching treatment is applied to the hot rolled steel plate from a temperature of $Ar_3$ transformation point or above and, subsequently, the quenched plate is tempered thus obtaining high-strength abrasion resistant steel. According to the description of the technique described in patent literature 1, the improvement of hardenability and the improvement of low-temperature toughness through strengthening of grain boundaries are achieved by allowing the steel to contain a large amount of Cr and a large amount of Mo. Further, according to the description of the technique described in patent literature 1, the further enhancement of low-temperature toughness is achieved by applying tempering treatment to the steel.

Patent literature 2 proposes a high toughness abrasion resistant steel plate which has the composition containing by mass %: 0.18% to 0.25% C, 0.10% to 0.30% Si, 0.03% to 0.10% Mn, proper amounts of Nb, Al, N and B respectively, 1.00% to 2.00% Cr, and more than 0.50% to 0.80% Mo, and exhibits excellent toughness and excellent delayed fracture resistance after water quenching and tempering. According to the description of a technique described in patent literature 2, by suppressing the content of Mn to a low level, and by allowing the steel plate to contain a large amount of Cr and a large amount of Mo, hardenability can be enhanced so that predetermined hardness can be ensured and, at the same time, toughness and delayed fracture resistance can be enhanced. Further, according to the description of the technique described in patent literature 2 further improves low-temperature toughness by further applying tempering.

Patent literature 3 proposes a high toughness and abrasion resistant steel which has the composition containing by mass %: 0.30% to 0.45% C, 0.10% to 0.50% Si, 0.30% to 1.20% Mn, 0.50% to 1.40% Cr, 0.15% to 0.55% Mo, 0.0005% to 0.0050% B, 0.015% to 0.060% sol. Al, and proper amounts of Nb and/or Ti. According to the description of the technique described in patent literature 3, the steel contains a large amount of Cr and a large amount of Mo and hence, hardenability is enhanced and, at the same time, grain boundaries are strengthened thus enhancing low-temperature toughness.

Patent literature 4 proposes a method of manufacturing an abrasion resistant steel, wherein hot-rolling is applied to steel having the composition containing by mass %: 0.05% to 0.40% C, 0.1% to 2.0% Cr, proper amounts of Si, Mn, Ti, B, Al and N respectively and, further, Cu, Ni, Mo, and V as arbitrary components at a cumulative reduction ratio of 50% or more in an austenitic non-recrystallized temperature range at a temperature of 900° C. or below, thereafter, quenching is applied to a hot-rolled plate from a temperature of $Ar_a$ transformation point or above and, subsequently, the quenched plate is tempered thus abrasion resistant steel being obtained. According to the description of this technique, directly quenching and tempering elongated austenite grains result the tempered martensitic structure where prior austenite grains are elongated. The tempered martensitic structure of the elongated grains remarkably enhances low-temperature toughness.

Further, patent literature 5 proposes an abrasion resistant steel plate having excellent low-temperature toughness and having the composition containing by mass %: 0.10% to 0.30% C, 0.05% to 1.0% Si, 0.1% to 2.0% Mn, 0.10% to 1.40% W, 0.0003% to 0.0020% B, 0.005% to 0.10% Ti and/or 0.035% to 0.1% Al. In the description of the technique described in patent literature 5, the abrasion resistant steel plate may further contain one or more kinds of elements selected from a group consisting of Cu, Ni, Cr and V. Due to such composition, in the technique described in patent literature 5, it is considered that the abrasion resistant steel plate has high surface hardness and exhibits excellent abrasion resistance and excellent low-temperature toughness.

Further, in patent literature 6, an abrasion resistant steel plate having excellent bending property is described. The abrasion resistant steel plate described in patent literature 6 is an abrasion resistant steel plate having the composition containing by mass %: 0.05% to 0.30% C, 0.1% to 1.2% Ti, and not more than 0.03% solute C, and having the structure wherein a matrix is formed of a ferrite phase and a hard phase is dispersed in the matrix. The abrasion resistant steel plate may further contain one or two kinds of components selected from a group consisting of Nb and V, one or two kinds of components selected from a group consisting of Mo and W, one or two kinds of components selected from a group consisting of Si, Mn and Cu, one or two kinds of components selected from a group consisting of Ni and B, and Cr. Due to such composition, in the technique described in patent literature 6, it is considered that both abrasion resistance and bending property against abrasion caused by earth and sand can be enhanced without inducing remarkable increase of hardness.

CITATION LIST

Patent Literature

PTL 1: JP-A-H08-41535
PTL 2: JP-A-H02-179842
PTL 3: JP-A-S61-166954
PTL 4: JP-A-2002-20837
PTL 5: JP-A-2007-92155
PTL 6: JP-A-2007-197813

SUMMARY

The abrasion resistant steel plate according to embodiments has excellent low-temperature toughness and relates to an abrasion resistant steel plate which can be suitably used as parts which are used in places where wear or abrasion generated due to a contact of the abrasion resistant steel plate with earth and sand containing water must be particularly taken into consideration.

Technical Problem

However, the respective techniques described in patent literatures 1 to 5 aim at the acquisition of the steel plates having low-temperature toughness and abrasion resistance. Further, the technique described in patent literature 6 aims at the acquisition of the steel plate having both bending property and abrasion resistance. However, in none of these patent literatures, the wear in an environment which contains a corrosive material such as earth and sand in a wet state has been studied and hence, there exists a drawback that consideration has not been made with respect to corrosive wear resistance.

Further, in the respective techniques described in patent literatures 1 to 4, tempering treatment is a requisite and hence, there exists a drawback that a manufacturing cost is increased. In the technique described in patent literature 5, the steel plate contains W as an indispensable component and hence, there exists a drawback that a manufacturing cost is increased. In the technique described in patent literature 6, the main phase is formed of ferrite and hence, surface hardness is low whereby the steel plate cannot acquire sufficient abrasion resistance.

The present application has been made to overcome the above-mentioned drawbacks of the related art, and it is an object of this disclosure to provide an abrasion resistant steel plate which can be manufactured at a low cost, and possesses excellent abrasion resistance, having all of excellent low-temperature toughness and excellent corrosive wear resistance.

Solution to Problem

To achieve the above-mentioned object, inventors of the present application have made extensive studies on the influence of various factors exerted on abrasion resistance, low-temperature toughness and corrosive wear resistance. As a result of the studies, the inventors haw found that the corrosive wear resistance of a steel plate can be remarkably enhanced by making the steel plate have the composition containing proper amounts of Cr and/or Mo as indispensable components, and by adjusting the content of solute Cr in steel and the content of solute Mo in steel such that the following formula (1) is satisfied.

$$0.05 \geq (Crsol+2.5Mosol) \geq 2.0 \quad (1)$$

(Here, Crsol: the content of solute Cr in steel (mass %), Mosol: the content of solute Mo in steel (mass %))

It is supposed that by allowing the steel plate to contain proper amounts of Cr and/or Mo as indispensable components and by allowing the steel plate to ensure proper amounts of solute Cr and solute Mo, even when the steel plate is exposed to earth and sand in a wet state having pH in a wide range, Cr and/or Mo exist as an oxyacid and hence, corrosive wear is suppressed.

The inventors also have found that abrasion resistance and corrosive wear resistance against abrasion caused by earth and sand can be remarkably enhanced by maintaining surface hardness at a high level provided that the steel plate has the above-mentioned composition.

The inventors also have found that hardenability of the steel plate can be enhanced by allowing the steel plate to contain proper amounts of Cr and/or Mo as indispensable components and by adjusting the composition of the steel plate such that the steel plate contains proper amounts of at least C, Si, Mn, P, S and Al, in addition, the excellent low-temperature toughness can also be surely acquired by ensuring the structure where an as-quenched martensitic phase forms a main phase and a grain size of prior austenite (γ) grains is 30 μm or less.

The present application has been made based on the above-mentioned findings and has been completed after further study of the findings. Aspects of embodiments of this disclosure are described below.

(1) An abrasion resistant steel plate having excellent low temperature toughness and excellent corrosive wear resistance, the steel plate having a composition containing by mass %: 0.10% to 0.20% C, 0.05% to 1.00% Si, 0.1% to 2.0% Mn, 0.020% or less P, 0.005% or less S, 0.005% to 0.100% Al, one or two kinds of components selected from a group consisting of 0.05% to 2.0% Cr and 0.05% to 1.0% Mo, and remaining Fe and unavoidable impurities as a balance, wherein the content of solute Cr in steel and the content of solute Mo in steel satisfy a following formula (1), the steel plate having a structure where an as-quenched martensitic phase forms a main phase and a grain size of prior austenite grains is 30 μm or less, and surface hardness of the steel plate being 360 or more at Brinel hardness HBW10/3000.

$$0.05 \geq (Crsol+2.5Mosol) \geq 2.0 \quad (1)$$

where, Crsol: the content of solute Cr in steel (mass %), Mosol: the content of solute Mo in steel (mass %)

(2) In the abrasion resistant steel plate described in (1), the steel composition further contains by mass % one or two or more kinds of components selected from a group consisting of 0.005% to 0.1% Nb, 0.005% to 0.1% Ti, and 0.005% to 0.1% V.

(3) In the abrasion resistant steel plate described in (1) or (2), the steel composition further contains by mass % one or two kinds of components selected from a group consisting of 0.005% to 0.2% Sn and 0.005% to 0.2% Sb.

(4) In the abrasion resistant steel plate described in any of (1) to (3), the steel composition further contains by mass % one or two or more kinds of components selected from a group consisting of 0.03% to 1.0% Cu, 0.03% to 2.0% Ni, and 0.0003% to 0.0030% B.

(5) In the abrasion resistant steel plate described in any of (1) to (4), the steel composition further contains by mass % one or two or more kinds of components selected from a group consisting of 0.0005% to 0.008% REM, 0.0005% to 0.005% Ca, and 0.0005% to 0.005% Mg.

Advantageous Effects

According to embodiments, it is possible to manufacture, easily and in a stable manner, an abrasion resistant steel plate having excellent corrosive wear resistance in an earth-and-sand abrasion environment in a wet state, having excellent low-temperature toughness, and excellent abrasion resistance in a stable manner without lowering surface hardness.

DESCRIPTION OF EMBODIMENTS

Firstly, the reasons for limiting the composition of the abrasion resistance steel plate of disclosed embodiments are explained. In the explanation made hereinafter, mass % is simply expressed by % unless otherwise specified.

C: 0.10% to 0.20%

C is an important element for increasing hardness of the steel plate and for enhancing abrasive resistance. When the content of C is less than 0.10%, the steel plate cannot acquire sufficient hardness. On the other hand, when the content of C exceeds 0.20%, weldability, low-temperature toughness and workability are lowered. Accordingly, the content of C is limited to a value which falls within a range from 0.10% to 0.20%. The content of C is preferably limited to a value which falls within a range from 0.14% to 0.17%.

Si: 0.05% to 1.00%

Si is an effective element acting as a deoxidizing agent for molten steel. Si is also an element which effectively contributes to the enhancement of strength of the steel plate by solid solution strengthening. The content of Si is set to 0.05% or more to ensure such effects. When the content of Si is less than 0.05%, a deoxidizing effect cannot be sufficiently acquired. On the other hand, when the content of Si exceeds 1.0%, ductility and toughness are lowered, and the content of inclusions in the steel plate is increased. Accordingly, the content of Si is limited to a value which falls within a range from 0.05% to 1.0%. The content of Si is preferably limited to a value which falls within a range from 0.2% to 0.5%.

Mn: 0.1% to 2.0%

Mn is an effective element having an action of enhancing hardenability. To ensure such an effect, the content of Mn is set to 0.1% or more. On the other hand, when the content of Mn exceeds 2.0%, weldability is lowered. Accordingly, the content of Mn is limited to a value which falls within a range from 0.1% to 2.0%. The content of Mn is preferably limited to a value which falls within a range from 0.4% to 1.6%. It is more preferable that the content of Mn is limited to a value which falls within a range from 0.7% to 1.4%.

P: 0.020% or Less

When the content of P in steel is large, lowering of low-temperature toughness is induced and hence, it is desirable that the content of P be as small as possible. In embodiments, the permissible content of P is 0.020%. Accordingly, the content of P is limited to 0.020% or less. The excessive reduction of the content of P induces the sharp rise in a refining cost and hence, it is desirable to set the content of P to 0.005% or more.

S: 0.005% or Less

When the content of S in steel is large, S is precipitated as MnS. In high strength steel, MnS becomes an initiation point of the occurrence of fracture and induces deterioration of toughness. Accordingly, it is desirable that the content of S be as small as possible. In embodiments, the permissible content of S is 0.005%. Accordingly, the content of S is limited to 0.005% or less. The excessive reduction of the content of S induces the sharp rise of a refining cost and hence, it is desirable to set the content of S to 0.0005% or more.

Al: 0.005% to 0.100%

Al is an effective element acting as a deoxidizing agent for molten steel. Further, Al contributes far the enhancement of low-temperature toughness due to refining of crystal grains. To acquire such an effect, the content of Al is set to 0.005% or more. When the content of Al is less than 0.005%, such an effect cannot be sufficiently acquired. On the other hand, when the content of Al exceeds 0.100%, weldability is lowered. Accordingly, the content of Al is limited to a value which falls within a range from 0.005% to 0.100%. The content of Al is preferably limited to a value which falls within a range from 0.015% to 0.050%.

One or Two Kinds of Components Selected from 0.05% to 2.0% Cr or 0.05% to 1.0% Mo Both Cr and Mo have an action of suppressing corrosive wear, and the steel plate optionally contains one kind or two kinds of Cr and Mo.

Cr has an effect of increasing hardenability thus making a martensitic phase finer so as to enhance low-temperature toughness. Accordingly, in embodiments, Cr is an important element. Further, in a corrosive wear environment where a contact between a steel plate and earth and sand or the like in a wet state becomes a problem, Cr is dissolved as chromate ion due to an anodic reaction, and suppresses corrosion due to an inhibitor effect thus giving rise to an effect of enhancing corrosive wear resistance. To acquire such an effect, the content of Cr is set to 0.05% or more. When the content of Cr is less than 0.05%, the steel plate cannot exhibit such an effect sufficiently. On the other hand, when the content of Cr exceeds 2.0%, weldability is lowered and a manufacturing cost is sharply increased. Accordingly, the content of Cr is limited to a value which falls within a range from 0.05% to 2.0%. It is preferable to limit the content of Cr to a value which falls within a range from 0.07% to 1.20%.

Mo has an effect of increasing hardenability thus making a martensitic phase finer so as to enhance low-temperature toughness. Accordingly, in embodiments, Mo is an important element. Further, in a corrosive wear environment where a contact between a steel plate and earth and sand or the like in a wet state becomes a problem, Mo is dissolved as molybdate ion due to an anodic reaction, and suppresses corrosion by an inhibitor effect thus giving rise to an effect of enhancing corrosive wear resistance. To acquire such an effect, the content of Mo is set to 0.05% or more. When the content of Mo is less than 0.05%, the steel plate cannot exhibit such an effect sufficiently. On the other hand, when the content of Mo exceeds 1.0%, weldability is lowered and a manufacturing cost is sharply increased. Accordingly, the content of Mo is limited to a value which falls within a range from 0.05% to 1.0%. It is preferable to limit the content of Mo to a value which falls within a range from 0.10% to 0.50%.

By containing both Cr and Mo, it is expected that corrosive wear resistance can be enhanced remarkably. It is based on the estimation that corrosive wear caused by earth and sand or the like in a wet state having pH in a wide range can be suppressed, since Cr and Mo have different pH regions respectively where Cr or Mo can exist as an oxygen acid.

To enhance corrosive wear resistance, in embodiments, the steel plate contains Cr and Mo which fall within the above-mentioned ranges, and the content of solute Cr in steel and the content of solute Mo in steel can be adjusted so as to satisfy the following formula (1).

$$0.05 \geq (Crsol+2.5Mosol) \geq 2.0 \quad (1)$$

(Crsol: the content of solute Cr in steel (mass %), Mosol: the content of solute Mo in steel (mass %))

When Cr and Mo form carbides or the like and carbides or the like are precipitated as precipitates, the content of solute Cr or the content of solute Mo is decreased around the precipitates. Accordingly, the above-mentioned inhibitor effect is decreased so that corrosive wear resistance is lowered. According to embodiments, the content of solute Cr in steel (Crsol) and the content of solute Mo in steel (Mosol) are adjusted so as to satisfy the above-mentioned formula (1). To sufficiently ensure the above-mentioned inhibitor effect, it is necessary to set (Crsol+2.5Mosol) to 0.05 or more. On the other hand, when (Crsol+2.5Mosol) exceeds 2.0, the inhibitor effect is saturated and, at the same time, a manufacturing cost sharply rises. It is preferable that (Crsol+2.5Mosol) is set to a value which falls within a range from 0.10 to 1.0.

The content of solute Cr and the content of solute Mo can be calculated by the following method. Steel is extracted by electrolysis in electrolytic solution containing 10% acetylacetone, and an obtained extracted residue (precipitates) is analyzed by an inductively coupled plasma atomic emission spectrophotometry method. The content of Cr contained in the extracted residue and the content of Mo contained in the extracted residue are respectively determined as the content of precipitated Cr and the content of precipitated Mo. The content of solute Cr and the content of solute Mo are obtained by subtracting the determined values from the total content of Cr and the total content of Mo respectively.

Further, to enable the content of solute Cr and the content of solute Mo to satisfy the formula (1), it is necessary to suppress the precipitation of carbide and the like as much as possible. For this end, it is necessary to adjust heat history or to control the content of Nb and the content of Ti. To be more specific, for example, it is desirable to make a time that steel is held in a temperature range (500° C. to 800° C.) where carbide or the like of Cr or Mo precipitates as short as possible or to add Nb or Ti which is more liable to form carbide or the like than Cr and Mo.

The above-mentioned components are the basic components of the steel according to this disclosure. Further, the steel according to embodiments may optionally contain, in addition to the above-mentioned basic components, as an optional element or optional elements, one or two or more kinds of components selected from a group consisting of 0.005% to 0.1% Nb, 0.005% to 0.1% Ti, and 0.005% to 0.1% V, and/or one or two kinds of components selected from a group consisting of 0.005% to 0.2% Sn and 0.005% to 0.2% Sb, and/or one or two or more kinds of components selected from a group consisting of 0.03% to 1.0% Cu, 0.03% to 2.0% Ni, and 0.0003% to 0.0030% B, and/or one or two or more kinds of components selected from a group consisting of 0.0005% to 0.008% REM, 0.0005% to 0.005% Ca, and 0.0005% to 0.005% Mg.

One or Two or More Kinds of Components Selected from a Group Consisting of 0.005% to 0.1% Nb, 0.005% to 0.1% Ti, and 0.005% to 0.1% V All of Nb, Ti and V are elements which precipitate as precipitates such as carbonitride and the like, and enhance toughness of steel through refining of the structure. In embodiments, when necessary, steel may contain one or two or more kinds of components selected from a group consisting of Nb, Ti and V.

Nb is an element which precipitates as carbonitride and effectively contributes to the enhancement of toughness through refining of the structure. The content of Nb may preferably be set to 0.005% or more for ensuring such an effect. On the other hand, when the content of Nb exceeds 0.1%, weldability is lowered. Accordingly, when the steel contains Nb, the content of Nb is preferably limited to a value which falls within a range from 0.005% to 0.1%. The content of Nb is more preferably set to a value which falls within a range from 0.012% to 0.03% from a view point of refining of the structure.

Ti is an element which precipitates as TiN and contributes to the enhancement of toughness through fixing solute N. The content of Ti is preferably set to 0.005% or more for acquiring such an effect. On the other hand, when the content of Ti exceeds 0.1%, coarse carbonitride precipitates so that toughness is lowered. Accordingly, when the steel contains Ti, the content of Ti is preferably limited to a value which falls within a range from 0.005% to 0.1%. The content of Ti is more preferably limited to a value which falls within a range from 0.005% to 0.03% from a view point of the reduction of a manufacturing cost.

V is an element which precipitates as carbonitride and contributes to the enhancement of toughness through an effect of refining the structure. The content of V is preferably set to 0.005% or more for acquiring such an effect. On the other hand, when the content of V exceeds 0.1%, weldability is lowered. Accordingly, when the steel contains V, the content of V is preferably limited to a value which falls within a range from 0.005% to 0.1%.

One or Two Kinds of Components Selected from a Group Consisting of 0.005% to 0.2% Sn and 0.005% to 0.2% Sb Both Sn and Sb are elements which enhance corrosive wear resistance. In embodiments, when necessary, steel may contain one or two kinds of elements selected from a group consisting of Sn and Sb.

Sn is dissolved as Sn ion due to an anodic reaction, and suppresses corrosion by an inhibitor effect thus enhancing corrosive wear resistance of a steel plate. Further, Sn forms an oxide film containing Sn on a surface of the steel plate and hence, an anodic reaction and a cathodic reaction of the steel plate are suppressed whereby corrosive wear resistance of the steel plate is enhanced. The content of Sn is preferably set to 0.005% or more for acquiring such an effect. On the other hand, when the content of Sn exceeds 0.2%, the deterioration of ductility and toughness of the steel plate are induced. Accordingly, when the steel contains Sn, the content of Sn is preferably limited to a value which falls within a range from 0.005% to 0.2%. The content of Sn is more preferably set to a value which falls within a range from 0.005% to 0.1% from a view point of reducing tramp elements.

Sb suppresses corrosion of a steel plate by suppressing an anodic reaction of the steel plate and also by suppressing a hydrogen generation reaction which is a cathodic reaction thus enhancing corrosive wear resistance. The content of Sb is preferably set to 0.005% or more for sufficiently acquiring such an effect. On the other hand, when the content of Sb exceeds 0.2%, the deterioration of toughness of the steel plate is induced. Accordingly, when the steel contains Sb, the content of Sb is preferably set to a value which falls within a range from 0.005% to 0.2%. It is more preferable that the content of Sb is set to a value which falls within a range from 0.005% to 0.1%.

One or two or more kinds of components selected from a group consisting of 0.03% to 1.0% Cu, 0.03% to 2.0% Ni, and 0.0003% to 0.0030% B All of Cu, Ni and B are elements which enhance hardenability. In embodiments, when necessary, steel may contain one or two or more kinds of elements selected from a group consisting of Cu, Ni and B.

Cu is an element which contributes to the enhancement of hardenability. The content of Cu may preferably be 0.03% or more for acquiring such an effect. On the other hand, when the content of Cu exceeds 1.0%, hot workability is lowered, and a manufacturing cost also sharply rises. Accordingly, when the steel contains Cu, the content of Cu is preferably limited to a value which falls within a range from 0.03% to 1.0%. The content of Cu is more preferably limited to a value which falls within a range from 0.03% to 0.5% from a view point of further reduction of a manufacturing cost.

Ni is an element which contributes to the enhancement of hardenability and also the enhancement of low-temperature toughness. The content of Ni may preferably be 0.03% or more for acquiring such an effect. On the other hand, when the content of Ni exceeds 2.0%, a manufacturing cost rises. Accordingly, when the steel contains Ni, the content of Ni is preferably limited to a value which falls within a range from 0.03% to 2.0%. The content of Ni is more preferably limited to a value which falls within a range from 0.03% to 0.5% from a viewpoint of further reduction of a manufacturing cost.

B is an element which contributes to the enhancement of hardenability with a small amount contained in steel. The content of B may preferably be 0.0003% or more for acquiring such an effect. On the other hand, when the content of B exceeds 0.0030%, toughness is lowered. Accordingly, when the steel contains B, the content of B is preferably limited to a value which falls within a range from 0.0003% to 0.0030%. The content of B more preferably falls within a range from 0.0003% to 0.0015% from a viewpoint of suppressing cold cracking at a welded part formed by a low-heat input welding such as $CO_2$ welding used in general in welding of an abrasion resistant steel plate.

One or Two or More Kinds of Components Selected from a Group Consisting of 0.0005% to 0.008% REM, 0.0005% to 0.005% Ca, and 0.0005% to 0.005% Mg All of REM, Ca and Mg are elements which form sulfide inclusions by combining with S and hence, these elements are elements which suppress the formation of MnS. In embodiments, when necessary, steel may contain one or two or more kinds of components selected from a group consisting of REM, Ca and Mg.

REM fixes S thus suppressing the formation of MnS which causes lowering of toughness. The content of REM may preferably be 0.0005% or more for acquiring such an effect. On the other hand, when the content of REM exceeds 0.008%, the content of inclusions in the steel is increased so that toughness is lowered to the contrary. Accordingly, when the steel contains REM, the content of REM is preferably limited to a value which falls within a range from 0.0005% to 0.008%. The content of REM is more preferably set to a value which falls within a range from 0.0005% to 0.0020%.

Ca fixes S thus suppressing the formation of MnS which causes lowering of toughness. The content of Ca may preferably be 0.0005% or more for acquiring such an effect. On the other hand, when the content of Ca exceeds 0.005%, the content of inclusions in the steel is increased so that toughness is lowered to the contrary. Accordingly, when the steel contains Ca, the content of Ca is preferably limited to a value which falls within a range from 0.0005% to 0.005%. The content of Ca is more preferably set to a value which falls within a range from 0.0005% to 0.0030%.

Mg fixes S thus suppressing the formation of MnS which causes lowering of toughness. The content of Mn may preferably be 0.0005% or more for acquiring such an effect. On the other hand, when the content of Mg exceeds 0.005%, the content of inclusions in the steel is increased so that toughness is lowered to the contrary. Accordingly, when the steel contains Mg, the content of Mg is preferably limited to a value which falls within a range from 0.0005% to 0.005%. It is more preferable that the content of Mg is set to a value which falls within a range from 0.0005% to 0.0040%.

The abrasion resistant steel plate according to embodiments has the above-mentioned composition, and further has a microstructure comprising an as-quenched martensitic phase forming a main phase and prior austenite (γ) grains with grain size of 30 μm or less. Here, a phase which occupies 90% or more in an area ratio is defined as "main phase".

As-Quenched Martensitic Phase: 90% or More in Area Ratio

When the phase fraction of the as-quenched martensitic phase is less than 90% in an area ratio, steel cannot ensure desired hardness, and wear resistance is lowered so that desired wear resistance cannot be ensured. Further, steel cannot ensure the sufficient low-temperature toughness. Further, in case of tempered martensite, Cr and Mo form carbide together with Fe when cementite is formed by tempering and hence, solute Cr and solute Mo, which are effective to ensure corrosion resistance, are decreased. Accordingly, the martensitic phase is held in as-quenched martensitic phase where the martensitic phase is not tempered. An area ratio of the as-quenched martensitic phase is preferably set to 95% or more.

Grain Size of Prior Austenite (γ) Grains: 30 μm or Less

Even when the as-quenched martensitic phase is ensured the area ratio of 90% or more, when a grain size of prior austenite (γ) grains becomes coarse exceeding 30 μm, the low-temperature toughness is lowered. As the grain size of prior austenite (γ) grains, values which are obtained in accordance with JIS G 0551 after microscopically observing the structure etched by a picric acid using an optical microscope (magnification: 400 times) are used.

The abrasion resistant steel plate having the above-mentioned composition and structure has surface hardness of 360 or more at Brinel hardness HBW 10/3000.

Surface Hardness: 360 or More at Brinel Hardness HBW 10/3000

When the surface hardness of steel is less than 360 at Brinel hardness HBW 10/3000, the lifetime of the abrasion resistant steel plate becomes short. Brinel hardness is measured in accordance with the stipulation described in JIS Z 2243 (2008).

Next, the preferred method of manufacturing the abrasion resistant steel plate of this disclosure is explained.

Steel material having the above-mentioned composition is subjected to hot rolling as it is without cooling when the steel material holds a predetermined temperature or after cooling and reheating, thus manufacturing a steel plate having a desired size and a desired shape.

The method of manufacturing the steel material is not particularly limited. It is desirable that molten steel having the above-mentioned composition is produced using a known refining method such as using a converter, and a steel material such as a slab having a predetermined size is manufactured by a known casting method such as a continuous casting method. It goes without saying that a steel material can be manufactured by an ingot casting-blooming method.

Reheating Temperature: 950 to 1250° C.

When the reheating temperature is below 950° C., the deformation resistance becomes excessively high so that a rolling load becomes excessively large whereby hot rolling may not be performed. On the other hand, when the reheating temperature becomes high exceeding 1250° C., the crystal grains become excessively coarse so that steel cannot ensure desired high toughness. Accordingly, the reheating temperature is preferably limited to a value which falls within a range from 950 to 1250° C.

The reheated steel material or the steel material which holds a predetermined temperature without being reheated is, then, subjected to hot rolling so that a steel plate having a desired size and a desired shape is manufactured. The hot rolling condition is not particularly limited. After the hot rolling is finished, it is preferable that direct quenching treatment (DQ), where the steel plate is quenched immediately after the hot rolling finish, is applied to the steel plate. It is preferable that a quenching start temperature is set to a temperature not below an Ar3 transformation point. To set the quenching start temperature equal to or higher than the Ar3 transformation point, it is preferable to set the hot rolling finish temperature to a value which falls within a range from 800 to 950° C., being equal to or higher than the Ar3 transformation point. A quenching cooling rate is not particularly limited provided that the quenching cooling rate is equal to or higher than a cooling rate at which a martensitic phase is formed.

A cooling stop temperature is preferably set to a temperature equal to or below an Ms point. It is more preferable that the cooling stop temperature is set to 300° C. or below for preventing an as-quenched martensitic phase from being self-tempered. It is further preferable that the cooling stop temperature is set to 200° C. or below.

After the hot rolling is finished, in place of the direct quenching treatment where a steel plate is immediately quenched, reheating quenching treatment (RQ) may be performed where the steel plate is cooled by air after the hot rolling is finished, thereafter, the steel plate is reheated to a predetermined heating temperature and, then, the steel plate is quenched. It is desirable that the reheating quenching temperature is set to a value which falls within a range from 850 to 950° C. A quenching cooling rate after reheating is not particularly limited provided that the quenching cooling rate after reheating is equal to or higher than a cooling rate at which a martensitic phase is formed. A cooling stop temperature is preferably set to a temperature equal to or below an Ms point. The cooling stop temperature is more preferably set to 300° C. or below for preventing an as-quenched martensitic phase from being self-tempered. The cooling stop temperature is further preferably set to 200° C. or below.

Example 1

Hereinafter, disclosed embodiments are further explained based on examples.

Molten steel having the composition described in Table 1 was produced by a vacuum melting furnace, and was cast into a mold so that ingots (steel material) having a weight of 150 kgf respectively were manufactured. These steel materials were heated at reheating temperatures described in Tables 2 and 3 and, thereafter, the steel materials were subjected to hot rolling under conditions described in Table 2 and Table 3, and direct quenching treatment (DQ) was performed where quenching is immediately performed after the hot rolling is finished (direct quenching). Reheating quenching treatment (RQ) was applied to some steel plates where the steel plates were cooled by air after the hot rolling was finished, the steel plates were reheated at heating temperatures described in Tables 2, 3 and, thereafter, quenching was performed.

Specimens were sampled from the manufactured steel plates, and specimens were subject to an observation of the structure, a surface hardness test, a Charpy impact test, and a corrosive wear resistance test. Specimens for electrolytic extraction were sampled from the manufactured steel plates, and the specimens were subjected to electrolysis in a 10% AA electrolytic solution (10% acetylacetone-1% tetramethylammonium chloride-methyl alcohol electrolytic solution), and residues were extracted. With respect to each of the obtained extracted residues, the content of Cr contained in the extracted residue and the content of Mo contained in the extracted residue were analyzed using an inductively coupled plasma atomic emission spectrophotometry method, and the content of Cr in the form of precipitates and the content of Mo in the form of precipitates were calculated. The content of solute Cr (Crsol) and the content of solute Mo (Mosol) were obtained by subtracting the content of Cr in the form of precipitates and the content of Mo in the form of precipitates from the total content of Cr and the total content of Mo respectively.

The following test methods were adopted.

(1) Observation of Structure

Specimens for structure observation were sampled from manufactured steel plates at a position of ½ plate thickness of the steel plate such that an observation surface becomes a cross section perpendicular to the rolling direction. The specimens were polished and were etched by a picric acid to expose prior γ grains and, thereafter, subjected to observation by an optical microscope (magnification: 400 times). Equivalent circle diameters of respective 100 grains of prior γ grains were measured, an arithmetic mean was calculated based on obtained equivalent circle diameters, and the arithmetic mean was set as the prior γ grain size of the steel plate.

Thin film specimens (specimens for observation of structure by transmission electron microscope) were sampled from the manufactured steel plates at a position of ½ plate thickness of the steel plate being parallel to a surface of the plate. The specimen was grinded and polished (mechanical polishing, electrolytic polishing) thus forming a thin film. Next, 20 fields of vision for each were observed by a transmission electron microscope (magnification: 20000 times). A region where cementite does not precipitate was set as an as-quenched martensitic phase region, and the area of the region was measured. The area of the as-quenched martensitic phase region was indicated by a ratio (%) with respect to the whole structure, and this ratio was set as an as-quenched martensitic fraction (area ratio).

(2) Surface Hardness Test

Specimens for surface hardness measurement were sampled from the manufactured steel plates, and surface hardness HBW 10/3000 was measured in accordance with JIS Z 2243 (2008). In the hardness measurement, a tungsten hard ball having a diameter of 10 mm was used, and a load was set to 3000 kgf.

(3) Charpy Impact Test

V-notched specimens were sampled from manufactured steel plates at a position of ½ plate thickness of the steel plate away from a surface of the steel plate in the direction (C direction) perpendicular to the rolling direction in accordance with the stipulation of JIS Z 2242 (2005), and a Charpy impact test was performed. A test temperature was set to −40° C. and absorbed energy $vE_{-40}$ (J) was obtained. The number of specimens was three for each of steel plates, and an arithmetic mean of the three specimens is set as the absorbed energy $vE_{-40}$ of the steel plate. The steel plate having the absorbed energy $vE_{-40}$ of 30 J or more was evaluated as the steel plate having excellent "base material low-temperature toughness". With respect to the steel plates having a plate thickness of less than 10 mm, ½ t sub-size Charpy specimens were used (t: plate thickness). In the case of the ½ t sub-size Charpy specimens, the steel plate having the absorbed energy $vE_{-40}$ of 15 J or more was evaluated as the steel plate having excellent "base material toughness".

(4) Corrosive Wear Resistance Test

Wear specimens (size: thickness of 10 mm, width of 25 mm and length of 75 mm) were sampled from manufactured steel plates at a position 1 mm away from a surface of the manufactured steel plate. These wear specimens were mounted on a wear tester, and a wear test was carried out.

The wear specimen was mounted on the wear tester such that the wear specimen was perpendicular to an axis of rotation of a rotor of the tester and a surface of 25 mm×75 mm was parallel to the circumferential tangential direction of a rotating circle, the specimen and the rotor were covered with an outer vessel, and a wear material was introduced into the inside of the outer vessel. As the wear material, a mixture is used where silica sand having an average particle size of 0.65 mm and an NaCl aqueous solution which was prepared such that the concentration becomes 15000 mass ppm were mixed together such that a weight ratio between silica sand and the NaCl aqueous solution becomes 3:2.

Test conditions were set such that the rotor was rotated at 600 rpm and the outer vessel was rotated at 45 rpm. The test was finished at the revolutions of the rotor became 10800 times in total. After the test was finished, weights of the respective specimens were measured. The difference between the weight after test and the initial weight (=an amount of reduction of weight) was calculated, and a wear resistance ratio (=(reference value)/(amount of reduction of weight of specimen)) was calculated using an amount of reduction of weight of steel stipulated in Rolled steels for general structure, Tensile strength 400 MPa class SS400 (JIS G3101) (conventional example) as a reference value. When the wear resistance ratio was 1.5 or more, the steel plate was evaluated as the steel plate "having excellent corrosive wear resistance".

The measured results are shown in Table 4 and Table 5.

TABLE 1

| Steel Number | Chemical Composition (mass %) | | | | | | | | | | | | Ar3 Transformation Point | |
|---|---|---|---|---|---|---|---|---|---|---|---|---|---|---|
| | C | Si | Mn | P | S | sol. Al | Cr | Mo | Nb, Ti, V | Sn, Sb | Cu, Ni, B | REM, Ca, Mg | (° C.) | Remarks |
| A | 0.15 | 0.36 | 1.38 | 0.007 | 0.0017 | 0.032 | 0.11 | | | | | | 751 | within scope of disclosed embodiments |
| B | 0.13 | 0.29 | 0.42 | 0.009 | 0.0026 | 0.028 | 1.37 | | | | Cu: 0.07, Ni: 0.15 | | 806 | within scope of disclosed embodiments |
| C | 0.15 | 0.33 | 1.05 | 0.009 | 0.0019 | 0.021 | 0.40 | | Nb: 0.02, Ti: 0.016 | | B: 0.0015 | | 774 | within scope of disclosed embodiments |
| D | 0.19 | 0.31 | 1.15 | 0.008 | 0.0026 | 0.021 | | 0.12 | | | | | 750 | within scope of disclosed embodiments |
| E | 0.20 | 0.25 | 1.64 | 0.008 | 0.0018 | 0.023 | | 0.21 | Ti: 0.014 | | | REM: 0.0015 | 700 | within scope of disclosed embodiments |
| F | 0.12 | 0.35 | 0.52 | 0.007 | 0.0017 | 0.030 | | 0.56 | V: 0.041 | | | Ca: 0.0019 | 786 | within scope of disclosed embodiments |
| G | 0.14 | 0.29 | 1.12 | 0.007 | 0.0026 | 0.029 | 0.06 | 0.07 | Ti: 0.014, V: 0.016 | | B: 0.0009 | Mg: 0.0011 | 771 | within scope of disclosed embodiments |
| H | 0.17 | 0.31 | 1.01 | 0.008 | 0.0021 | 0.024 | 0.41 | 0.09 | | | | | 763 | within scope of disclosed embodiments |
| I | 0.16 | 0.25 | 0.49 | 0.011 | 0.0016 | 0.027 | 0.81 | 0.21 | Nb: 0.018 | | B: 0.0025 | | 792 | within scope of disclosed embodiments |
| J | 0.15 | 0.34 | 1.21 | 0.010 | 0.0023 | 0.023 | 0.09 | 0.14 | Nb: 0.02, Ti: 0.014 | | B: 0.0013 | | 754 | within scope of disclosed embodiments |
| K | 0.16 | 0.32 | 0.99 | 0.008 | 0.0025 | 0.026 | 1.01 | 0.22 | Nb: 0.02, Ti: 0.014 | | B: 0.0011 | | 748 | within scope of disclosed embodiments |
| L | 0.15 | 0.33 | 0.93 | 0.009 | 0.0021 | 0.028 | 0.76 | 0.36 | Nb: 0.019, Ti: 0.015, V: 0.045 | | B: 0.0013 | | 749 | within scope of disclosed embodiments |
| M | 0.15 | 0.36 | 1.01 | 0.008 | 0.0022 | 0.022 | 0.10 | 0.25 | Nb: 0.019, Ti: 0.013 | | B: 0.0012 | | 761 | within scope of disclosed embodiments |

TABLE 1-continued

| Steel Number | Chemical Composition (mass %) | | | | | | | | | | | | Ar3 Transformation Point | |
|---|---|---|---|---|---|---|---|---|---|---|---|---|---|---|
| | C | Si | Mn | P | S | sol. Al | Cr | Mo | Nb, Ti, V | Sn, Sb | Cu, Ni, B | REM, Ca, Mg | (° C.) | Remarks |
| N | 0.16 | 0.29 | 0.95 | 0.007 | 0.0019 | 0.026 | 0.31 | | Nb: 0.019, Ti: 0.014 | Sn: 0.035 | B: 0.0013 | | 780 | within scope of disclosed embodiments |
| O | 0.14 | 0.21 | 1.35 | 0.007 | 0.0023 | 0.025 | 0.08 | 0.21 | Nb: 0.020, Ti: 0.012 | Sn: 0.067 | B: 0.0014 | | 741 | within scope of disclosed embodiments |
| P | 0.15 | 0.26 | 1.09 | 0.007 | 0.0029 | 0.030 | 0.80 | 0.33 | Nb: 0.017, Ti: 0.014 | Sn: 0.045, Sb: 0.044 | B: 0.0009 | | 738 | within scope of disclosed embodiments |
| Q | 0.18 | 0.29 | 0.87 | 0.007 | 0.0014 | 0.019 | 1.10 | 0.34 | Nb: 0.029, Ti: 0.021, V: 0.034 | | Cu: 0.24, Ni: 0.31 | Ca: 0.0012 | 719 | within scope of disclosed embodiments |
| R | 0.17 | 0.38 | 1.43 | 0.008 | 0.0016 | 0.023 | 0.02 | | Ti: 0.016, V: 0.019 | | | Ca: 0.0013 | 743 | outside scope of disclosed embodiments |
| S | 0.12 | 0.37 | 1.51 | 0.012 | 0.0023 | 0.030 | | 0.02 | | | B: 0.0031 | | 750 | outside scope of disclosed embodiments |
| T | 0.16 | 0.34 | 1.23 | 0.011 | 0.0019 | 0.021 | 0.04 | | Ti: 0.014, V: 0.025 | | Cu: 0.12 | | 759 | outside scope of disclosed embodiments |
| U | 0.14 | 0.28 | 1.36 | 0.007 | 0.0019 | 0.025 | 0.03 | 0.02 | | | Ni: 0.14 | Mg: 0.0021 | 748 | outside scope of disclosed embodiments |
| V | 0.08 | 0.35 | 0.98 | 0.008 | 0.0023 | 0.028 | 0.19 | 0.15 | Nb: 0.022 | | | | 792 | outside scope of disclosed embodiments |

Underlined values fall outside the scope of disclosed embodiments.

TABLE 2

| Steel Plate Number | Steel Number | Plate Thickness (mm) | Type of Treatment* | Hot Rolling: Reheating Temperature (° C.) | Hot Rolling: Rolling Finish Temperature (° C.) | Hot Rolling: Cooling Start Temperature (° C.) | Hot Rolling: Cooling Method | Hot Rolling: Cooling Stop Temperature (° C.) | Heat Treatment: Heating Temperature (° C.) | Heat Treatment: Cooling Method | Heat Treatment: Cooling Stop Temperature (° C.) |
|---|---|---|---|---|---|---|---|---|---|---|---|
| 1 | A | 12 | RQ | 1110 | 860 | — | cooled by air | — | 870 | cooled by water | 250 |
| 2 | A | 19 | DQ | 1110 | 870 | 840 | cooled by water | 200 | — | — | — |
| 3 | A | 35 | DQ | 1110 | 880 | 850 | cooled by water | 230 | — | — | — |
| 4 | B | 6 | RQ | 1120 | 910 | — | cooled by air | — | 880 | cooled by water | 150 |
| 5 | B | 19 | RQ | 1120 | 930 | — | cooled by air | — | 900 | cooled by water | 150 |
| 6 | B | 32 | DQ | 1120 | 870 | 800 | cooled by water | 150 | — | — | — |
| 7 | C | 6 | RQ | 1120 | 850 | — | cooled by air | — | 950 | cooled by water | 200 |
| 8 | C | 12 | RQ | 1120 | 860 | — | cooled by air | — | 870 | cooled by water | 200 |
| 9 | C | 19 | DQ | 1120 | 890 | 830 | cooled by water | 150 | — | — | — |
| 10 | D | 19 | DQ | 1050 | 840 | 810 | cooled by water | 150 | — | — | — |
| 11 | D | 25 | DQ | 1050 | 850 | 800 | cooled by water | 150 | — | — | — |
| 12 | D | 35 | DQ | 1050 | 880 | 820 | cooled by water | 130 | — | — | — |
| 13 | E | 6 | RQ | 1120 | 840 | — | cooled by air | — | 930 | cooled by water | 150 |
| 14 | E | 12 | RQ | 1120 | 870 | — | cooled by air | — | 900 | cooled by water | 150 |
| 15 | E | 20 | DQ | 1120 | 890 | 830 | cooled by water | 150 | — | — | — |
| 16 | F | 12 | RQ | 1120 | 890 | — | cooled by air | — | 900 | cooled by water | 150 |
| 17 | F | 19 | DQ | 1120 | 870 | 850 | cooled by water | 150 | — | — | — |
| 18 | F | 32 | DQ | 1120 | 890 | 840 | cooled by water | 170 | — | — | — |
| 19 | G | 20 | DQ | 1150 | 920 | 880 | cooled by water | 160 | — | — | — |
| 20 | G | 25 | RQ | 1150 | 930 | — | cooled by air | — | 900 | cooled by water | 150 |
| 21 | G | 35 | DQ | 1150 | 910 | 870 | cooled by water | 200 | — | — | — |
| 22 | H | 6 | RQ | 1120 | 910 | — | cooled by air | — | 880 | cooled by water | 150 |
| 23 | H | 19 | RQ | 1120 | 930 | — | cooled by air | — | 900 | cooled by water | 150 |
| 24 | H | 32 | RQ | 1120 | 870 | — | cooled by air | — | 900 | cooled by water | 150 |
| 25 | I | 12 | RQ | 1120 | 900 | — | cooled by air | — | 900 | cooled by water | 170 |
| 26 | I | 19 | RQ | 1120 | 920 | — | cooled by air | — | 910 | cooled by water | 170 |
| 27 | I | 25 | DQ | 1120 | 880 | 830 | cooled by water | 210 | — | — | — |
| 28 | I | 12 | DQ | 1170 | 900 | 860 | cooled by water | 210 | — | — | — |
| 29 | J | 25 | DQ | 1170 | 920 | 880 | cooled by water | 220 | — | — | — |
| 30 | J | 35 | RQ | 1170 | 880 | — | cooled by air | — | 900 | cooled by water | 160 |
| 37 | K | 6 | RQ | 1070 | 900 | — | cooled by air | — | 900 | cooled by water | 170 |

TABLE 2-continued

| Steel Plate Number | Steel Number | Plate Thickness (mm) | Type of Treatment* | Hot Rolling: Reheating Temperature (° C.) | Hot Rolling: Rolling Finish Temperature (° C.) | Hot Rolling: Cooling Start Temperature (° C.) | Hot Rolling: Cooling Method | Hot Rolling: Cooling Stop Temperature (° C.) | Heat Treatment: Heating Temperature (° C.) | Heat Treatment: Cooling Method | Heat Treatment: Cooling Stop Temperature (° C.) |
|---|---|---|---|---|---|---|---|---|---|---|---|
| 38 | K | 19 | RQ | 1170 | 920 | — | cooled by air | — | 900 | cooled by water | 170 |
| 39 | K | 25 | RQ | 1120 | 860 | — | cooled by air | — | 900 | cooled by water | 170 |
| 40 | L | 6 | RQ | 1120 | 880 | — | cooled by air | — | 870 | cooled by water | 170 |
| 41 | L | 19 | RQ | 1120 | 900 | — | cooled by air | — | 920 | cooled by water | 170 |
| 42 | L | 25 | RQ | 1120 | 890 | — | cooled by air | — | 900 | cooled by water | 170 |

Underlined values fall outside the scope of disclosed embodiments.
*DQ: direct quenching, RQ: reheating quenching

TABLE 3

| Steel Plate Number | Steel Number | Plate Thickness (mm) | Type of Treatment* | Hot Rolling: Reheating Temperature (° C.) | Hot Rolling: Rolling Finish Temperature (° C.) | Hot Rolling: Cooling Start Temperature (° C.) | Hot Rolling: Cooling Method | Hot Rolling: Cooling Stop Temperature (° C.) | Heat Treatment: Heating Temperature (° C.) | Heat Treatment: Cooling Method | Heat Treatment: Cooling Stop Temperature (° C.) |
|---|---|---|---|---|---|---|---|---|---|---|---|
| 43 | M | 12 | RQ | 1120 | 900 | — | cooled by air | — | 910 | cooled by water | 170 |
| 44 | M | 19 | DQ | 1120 | 870 | 840 | cooled by water | 220 | — | — | — |
| 45 | M | 32 | DQ | 1120 | 890 | 830 | cooled by water | 220 | — | — | — |
| 46 | N | 12 | RQ | 1120 | 900 | — | cooled by air | — | 900 | cooled by water | 150 |
| 47 | N | 25 | RQ | 1120 | 920 | — | cooled by air | — | 870 | cooled by water | 150 |
| 48 | N | 32 | RQ | 1120 | 900 | — | cooled by air | — | 880 | cooled by water | 150 |
| 49 | O | 6 | RQ | 1070 | 880 | — | cooled by air | — | 920 | cooled by water | 150 |
| 50 | O | 12 | RQ | 1070 | 900 | — | cooled by air | — | 910 | cooled by water | 150 |
| 51 | O | 19 | RQ | 1070 | 920 | — | cooled by air | — | 900 | cooled by water | 150 |
| 52 | P | 6 | RQ | 1120 | 920 | — | cooled by air | — | 880 | cooled by water | 150 |
| 53 | P | 25 | RQ | 1120 | 920 | — | cooled by air | — | 900 | cooled by water | 150 |
| 54 | P | 32 | RQ | 1120 | 860 | — | cooled by air | — | 910 | cooled by water | 150 |
| 55 | Q | 12 | RQ | 1080 | 900 | — | cooled by air | — | 910 | cooled by water | 150 |
| 56 | Q | 19 | DQ | 1080 | 880 | 840 | cooled by water | 150 | — | — | — |
| 57 | Q | 25 | DQ | 1080 | 860 | 820 | cooled by water | 150 | — | — | — |
| 58 | R | 6 | RQ | 1120 | 850 | — | cooled by air | — | 880 | cooled by water | 310 |
| 59 | R | 19 | DQ | 1120 | 870 | 830 | cooled by water | 320 | — | — | — |
| 60 | R | 35 | RQ | 1120 | 900 | — | cooled by air | — | 850 | cooled by water | 310 |
| 61 | S | 6 | DQ | 1150 | 880 | 840 | cooled by water | 310 | — | — | — |
| 62 | S | 19 | DQ | 1150 | 840 | 820 | cooled by water | 310 | — | — | — |
| 63 | S | 35 | DQ | 1150 | 820 | 810 | cooled by water | 310 | — | — | — |
| 64 | T | 19 | RQ | 1130 | 930 | — | cooled by air | — | 900 | cooled by water | 310 |
| 65 | T | 25 | DQ | 1130 | 920 | 890 | cooled by water | 310 | — | — | — |
| 66 | T | 35 | DQ | 1130 | 850 | 830 | cooled by water | 310 | — | — | — |
| 67 | U | 12 | RQ | 1200 | 860 | — | cooled by air | — | 900 | cooled by water | 320 |
| 68 | U | 25 | RQ | 1200 | 890 | — | cooled by air | — | 900 | cooled by water | 310 |
| 69 | U | 35 | DQ | 1200 | 880 | 840 | cooled by water | 310 | — | — | — |
| 70 | V | 12 | RQ | 1180 | 840 | — | cooled by air | — | 900 | cooled by water | 210 |
| 71 | V | 19 | RQ | 1180 | 930 | — | cooled by air | — | 930 | cooled by water | 210 |
| 72 | V | 30 | DQ | 1180 | 900 | 850 | cooled by water | 210 | — | — | — |

Underlined values fall outside the scope of disclosed embodiments.

*DQ: direct quenching, RQ: reheating quenching

TABLE 4

| Steel Plate Number | Steel Number | Solute Content Crsol + 2.5 Mosol (mass %) | Structure Grain Size of Prior Austenite Grain (μm) | Structure Martensite Fraction (area %) | Surface Hardness HBW 10/3000 | Low-temperature Toughness $vE_{-40}$ (J) | Corrosive Wear Resistance Wear Resistance Ratio (Reference: 1.0 (conventional example)) | Remarks |
|---|---|---|---|---|---|---|---|---|
| 1 | A | 0.07 | 26 | 93 | 405 | 40 | 1.59 | example |
| 2 | A | 0.08 | 21 | 91 | 413 | 36 | 1.54 | example |
| 3 | A | 0.07 | 19 | 90 | 418 | 33 | 1.51 | example |
| 4 | B | 1.21 | 19 | 95 | 382 | 60 | 2.23 | example |
| 5 | B | 1.18 | 21 | 93 | 386 | 83 | 2.28 | example |
| 6 | B | 1.20 | 23 | 91 | 390 | 80 | 2.27 | example |
| 7 | C | 0.36 | 20 | 94 | 427 | 47 | 1.67 | example |
| 8 | C | 0.35 | 22 | 93 | 430 | 72 | 1.73 | example |
| 9 | C | 0.35 | 24 | 91 | 431 | 60 | 1.66 | example |
| 10 | D | 0.23 | 27 | 93 | 469 | 50 | 1.57 | example |
| 11 | D | 0.25 | 28 | 92 | 472 | 47 | 1.53 | example |
| 12 | D | 0.26 | 29 | 90 | 474 | 42 | 1.56 | example |
| 13 | E | 0.44 | 23 | 96 | 479 | 40 | 1.77 | example |
| 14 | E | 0.45 | 21 | 94 | 482 | 61 | 1.80 | example |
| 15 | E | 0.44 | 24 | 92 | 486 | 57 | 1.75 | example |
| 16 | F | 1.03 | 19 | 94 | 365 | 75 | 2.12 | example |
| 17 | F | 1.05 | 21 | 93 | 364 | 72 | 2.18 | example |
| 18 | F | 1.04 | 24 | 91 | 362 | 69 | 2.14 | example |
| 19 | G | 0.21 | 22 | 93 | 406 | 65 | 1.61 | example |
| 20 | G | 0.22 | 24 | 91 | 397 | 70 | 1.66 | example |
| 21 | G | 0.22 | 23 | 91 | 401 | 66 | 1.66 | example |
| 22 | H | 1.21 | 23 | 95 | 433 | 40 | 2.22 | example |
| 23 | H | 1.18 | 25 | 93 | 436 | 55 | 2.24 | example |
| 24 | H | 1.20 | 24 | 91 | 430 | 59 | 2.21 | example |
| 25 | I | 1.13 | 10 | 96 | 435 | 101 | 2.29 | example |
| 26 | I | 1.14 | 14 | 94 | 438 | 97 | 2.22 | example |
| 27 | I | 1.12 | 13 | 93 | 440 | 93 | 2.20 | example |
| 28 | I | 0.29 | 17 | 94 | 410 | 85 | 2.00 | example |
| 29 | J | 0.30 | 18 | 95 | 413 | 80 | 2.01 | example |
| 30 | J | 0.29 | 14 | 91 | 406 | 84 | 2.02 | example |
| 37 | K | 1.33 | 9 | 96 | 436 | 73 | 2.44 | example |
| 38 | K | 1.35 | 13 | 93 | 430 | 100 | 2.47 | example |
| 39 | K | 1.31 | 11 | 95 | 433 | 105 | 2.45 | example |
| 40 | L | 1.23 | 10 | 97 | 420 | 72 | 2.27 | example |
| 41 | L | 1.25 | 11 | 95 | 419 | 103 | 2.28 | example |
| 42 | L | 1.26 | 10 | 95 | 416 | 104 | 2.22 | example |

Underlined values fall outside the scope of present invention.

TABLE 5

| Steel Plate Number | Steel Number | Solute Content Crsol + 2.5 Mosol (mass %) | Structure Grain Size of Prior Austenite Grain (μm) | Structure Martensite Fraction (area %) | Surface Hardness HBW 10/3000 | Low-temperature Toughness $vE_{-40}$ (J) | Corrosive Wear Resistance Wear Resistance Ratio (Reference: 1.0 (conventional example)) | Remarks |
|---|---|---|---|---|---|---|---|---|
| 43 | M | 0.36 | 13 | 95 | 415 | 83 | 1.97 | example |
| 44 | M | 0.35 | 17 | 93 | 413 | 79 | 1.99 | example |
| 45 | M | 0.37 | 19 | 91 | 409 | 77 | 1.95 | example |
| 46 | N | 0.22 | 16 | 94 | 440 | 81 | 2.09 | example |
| 47 | N | 0.22 | 13 | 92 | 432 | 89 | 2.03 | example |
| 48 | N | 0.21 | 15 | 91 | 425 | 83 | 2.00 | example |
| 49 | O | 0.35 | 15 | 95 | 405 | 55 | 2.10 | example |
| 50 | O | 0.36 | 14 | 94 | 409 | 86 | 2.06 | example |
| 51 | O | 0.35 | 13 | 93 | 403 | 92 | 2.10 | example |
| 52 | P | 1.21 | 15 | 98 | 425 | 55 | 2.40 | example |
| 53 | P | 1.19 | 14 | 96 | 419 | 81 | 2.42 | example |
| 54 | P | 1.18 | 15 | 96 | 423 | 80 | 2.42 | example |
| 55 | Q | 1.51 | 9 | 99 | 462 | 110 | 2.44 | example |
| 56 | Q | 1.50 | 7 | 98 | 466 | 99 | 2.47 | example |
| 57 | Q | 1.50 | 6 | 97 | 460 | 103 | 2.42 | example |
| 58 | R | 0.01 | 36 | 91 | 436 | 11 | 0.78 | comparative example |
| 59 | R | 0.01 | 34 | 93 | 441 | 24 | 0.73 | comparative example |
| 60 | R | 0.01 | 38 | 90 | 433 | 14 | 0.76 | comparative example |
| 61 | S | 0.01 | 35 | 88 | 355 | 13 | 0.80 | comparative example |

TABLE 5-continued

| Steel Plate Number | Steel Number | Solute Content: Crsol + 2.5 Mosol (mass %) | Structure: Grain Size of Prior Austenite Grain (μm) | Structure: Martensite Fraction (area %) | Surface Hardness HBW 10/3000 | Low-temperature Toughness $vE_{-40}$ (J) | Corrosive Wear Resistance: Wear Resistance Ratio (Reference: 1.0 (conventional example)) | Remarks |
|---|---|---|---|---|---|---|---|---|
| 62 | S | 0.02 | 33 | 87 | 352 | 25 | 0.70 | comparative example |
| 63 | S | 0.01 | 31 | 86 | 348 | 27 | 0.74 | comparative example |
| 64 | T | 0.04 | 29 | 90 | 435 | 25 | 0.92 | comparative example |
| 65 | T | 0.03 | 28 | 88 | 441 | 21 | 0.95 | comparative example |
| 66 | T | 0.03 | 29 | 88 | 440 | 23 | 1.00 | comparative example |
| 67 | U | 0.04 | 31 | 89 | 401 | 25 | 1.14 | comparative example |
| 68 | U | 0.04 | 32 | 87 | 396 | 22 | 1.07 | comparative example |
| 69 | U | 0.04 | 32 | 86 | 394 | 20 | 1.11 | comparative example |
| 70 | V | 0.29 | 24 | 91 | 290 | 60 | 0.64 | comparative example |
| 71 | V | 0.31 | 26 | 90 | 295 | 55 | 0.65 | comparative example |
| 72 | V | 0.30 | 23 | 92 | 299 | 53 | 0.66 | comparative example |

Underlined values fall outside the scope of disclosed embodiments.

All of the examples according to disclosed embodiments exhibit surface hardness of 360 or more in HBW 10/3000, excellent low-temperature toughness of $vE_{-40}$ of 30 J or more (15 J or more in a case of the ½ t specimen), and excellent corrosive wear resistance of the wear resistance ratio of 1.5 or more. On the other hand, the comparative examples which fall outside the scope of disclosed embodiments exhibit lowering of surface hardness, lowering of low-temperature toughness, lowering of corrosive wear resistance or lowering of two or more of these properties.

The invention claimed is:

1. An abrasion resistant steel plate having excellent low-temperature toughness and excellent corrosive wear resistance, the steel plate having a composition comprising:

0.10% to 0.20% C, by mass %;

0.05% to 1.00% Si, by mass %;

0.1% to 2.0% Mn, by mass %;

0.020% or less P, by mass %;

0.005% or less S, by mass %;

0.005% to 0.100% Al, by mass %;

at least one component selected from the group consisting of 0.05% to 2.0% Cr, by mass %, and 0.05% to 1.0% Mo, by mass %; and remaining Fe and unavoidable impurities as a balance, wherein the content of solute Cr in steel and the content of solute Mo in steel satisfy the following formula (1)

$$0.05 \leq (Crsol+2.5Mosol) \leq 2.0 \quad (1)$$

where Crsol is the content of solute Cr in steel (mass %), and Mosol is the content of solute Mo in steel (mass %), and the steel plate having a structure where an as-quenched martensitic phase forms a main phase and a grain size of prior austenite grains is in the range of 30 μm or less, and a surface hardness of the steel plate is in the range of 360 or more at Brinel hardness HBW10/3000.

2. The abrasion resistant steel plate according to claim 1, wherein the steel composition further comprises at least one component selected from the group consisting of 0.005% to 0.1% Nb, by mass %, 0.005% to 0.1% Ti, by mass %, and 0.005% to 0.1% V, by mass %.

3. The abrasion resistant steel plate according to claim 1, wherein the steel composition further comprises at least one component selected from the group consisting of 0.005% to 0.2% Sn, by mass %, and 0.005% to 0.2% Sb, by mass %.

4. The abrasion resistant steel plate according to claim 2, wherein the steel composition further comprises at least one component selected from the group consisting of 0.005% to 0.2% Sn, by mass %, and 0.005% to 0.2% Sb, by mass %.

5. The abrasion resistant steel plate according to claim 1, wherein the steel composition further comprises at least one component selected from the group consisting of 0.03% to 1.0% Cu, by mass %, 0.03% to 2.0% Ni, by mass %, and 0.0003% to 0.0030% B, by mass %.

6. The abrasion resistant steel plate according to claim 2, wherein the steel composition further comprises at least one component selected from the group consisting of 0.03% to 1.0% Cu, by mass %, 0.03% to 2.0% Ni, by mass %, and 0.0003% to 0.0030% B, by mass %.

7. The abrasion resistant steel plate according to claim 3, wherein the steel composition further comprises at least one component selected from the group consisting of 0.03% to 1.0% Cu, by mass %, 0.03% to 2.0% Ni, by mass %, and 0.0003% to 0.0030% B, by mass %.

8. The abrasion resistant steel plate according to claim 4, wherein the steel composition further comprises at least one component selected from the group consisting of 0.03% to 1.0% Cu, by mass %, 0.03% to 2.0% Ni, by mass %, and 0.0003% to 0.0030% B, by mass %.

9. The abrasion resistant steel plate according to claim 1, wherein the steel composition further comprises at least one component selected from the group consisting of 0.0005% to 0.008% REM, by mass %, 0.0005% to 0.005% Ca, by mass %, and 0.0005% to 0.005% Mg, by mass %.

10. The abrasion resistant steel plate according to claim 2, wherein the steel composition further comprises at least one component selected from the group consisting of 0.0005% to 0.008% REM, by mass %, 0.0005% to 0.005% Ca, by mass %, and 0.0005% to 0.005% Mg, by mass %.

11. The abrasion resistant steel plate according to claim 3, wherein the steel composition further comprises at least one component selected from the group consisting of 0.0005% to 0.008% REM, by mass %, 0.0005% to 0.005% Ca, by mass %, and 0.0005% to 0.005% Mg, by mass %.

12. The abrasion resistant steel plate according to claim 4, wherein the steel composition further comprises at least one component selected from the group consisting of 0.0005% to 0.008% REM, by mass %, 0.0005% to 0.005% Ca, by mass %, and 0.0005% to 0.005% Mg, by mass %.

13. The abrasion resistant steel plate according to claim 5, wherein the steel composition further comprises at least one component selected from the group consisting of 0.0005% to 0.008% REM, by mass %, 0.0005% to 0.005% Ca, by mass %, and 0.0005% to 0.005% Mg, by mass %.

14. The abrasion resistant steel plate according to claim 6, wherein the steel composition further comprises at least one component selected from the group consisting of 0.0005% to 0.008% REM, by mass %, 0.0005% to 0.005% Ca, by mass %, and 0.0005% to 0.005% Mg, by mass %.

15. The abrasion resistant steel plate according to claim 7, wherein the steel composition further comprises at least one component selected from the group consisting of 0.0005% to 0.008% REM, by mass %, 0.0005% to 0.005% Ca, by mass %, and 0.0005% to 0.005% Mg, by mass %.

16. The abrasion resistant steel plate according to claim 8, wherein the steel composition further comprises at least one component selected from the group consisting of 0.0005% to 0.008% REM, by mass %, 0.0005% to 0.005% Ca, by mass %, and 0.0005% to 0.005% Mg, by mass %.

* * * * *